US010062976B2

(12) United States Patent
Hoppe et al.

(10) Patent No.: US 10,062,976 B2
(45) Date of Patent: Aug. 28, 2018

(54) ELECTRICAL TERMINAL BLOCK

(71) Applicant: Phoenix Contact GmbH & Co. KG, Blomberg (DE)

(72) Inventors: Udo Hoppe, Blomberg (DE); Georg Grunenberg, Detmold (DE); Thorsten Rosin, Paderborn (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 72 days.

(21) Appl. No.: 15/122,640

(22) PCT Filed: Feb. 25, 2015

(86) PCT No.: PCT/EP2015/053866
§ 371 (c)(1),
(2) Date: Aug. 31, 2016

(87) PCT Pub. No.: WO2015/132099
PCT Pub. Date: Sep. 11, 2015

(65) Prior Publication Data

US 2017/0069980 A1 Mar. 9, 2017

(30) Foreign Application Priority Data

Mar. 4, 2014 (DE) ..... 10 2014 102 845

(51) Int. Cl.
*H01R 4/48* (2006.01)
*H01R 13/66* (2006.01)
*H01R 13/502* (2006.01)

(52) U.S. Cl.
CPC ..... *H01R 4/4845* (2013.01); *H01R 4/4836* (2013.01); *H01R 13/502* (2013.01); *H01R 13/66* (2013.01)

(58) Field of Classification Search
CPC .... H01R 4/4845; H01R 13/74; H01R 4/4836; H01R 13/66; H01R 13/502
See application file for complete search history.

(56) References Cited

U.S. PATENT DOCUMENTS 4,992,056 A * 2/1991 Douty ..... H01R 12/714 439/746
5,197,891 A * 3/1993 Tanigawa ..... H01R 12/716 439/83

(Continued)

FOREIGN PATENT DOCUMENTS

DE 6915548 U 12/1969
DE 7416664 U 11/1974

(Continued)

*Primary Examiner* — Briggitte R Hammond
(74) *Attorney, Agent, or Firm* — Leydig, Voit & Mayer, Ltd.

(57) ABSTRACT

An electrical terminal block arrangement includes a terminal block with at least one housing having a first insertion opening and a second insertion opening, and a clamping body including a contact metal, a first spring, and a second spring arranged inside the housing; a discharge resistor that includes a plug-in contact, the plug-in contact being plugged in through the first insertion opening of the housing; and a capacitor that includes at least one capacitor wire, the capacitor wire being inserted through the second insertion opening of the housing and being clamped and electrically contacted to the contact metal by the second spring. The plug-in contact of the discharge resistor is clamped and electrically contacted to the contact metal by the first spring.

8 Claims, 6 Drawing Sheets

(56) References Cited

U.S. PATENT DOCUMENTS 5,702,271 A * 12/1997 Steinman ..... H01R 12/716 439/607.25
5,711,680 A * 1/1998 Tsuneaki ..... H01R 12/58 439/83
5,788,539 A * 8/1998 Fedder ..... H01R 4/2429 439/682
6,095,865 A * 8/2000 Wu ..... H01R 23/6873 439/607.01
6,287,130 B1 * 9/2001 Torii ..... H01R 12/707 439/83
7,556,515 B2 * 7/2009 Kato ..... H01R 33/02 439/171
7,704,082 B2 * 4/2010 Daily ..... H01R 12/57 439/83
7,789,677 B2 * 9/2010 Yang ..... H01R 12/7052 439/564
7,850,466 B2 * 12/2010 Mostoller ..... H01R 12/57 439/83
8,100,703 B2 * 1/2012 Chen ..... H01R 12/716 439/83
8,550,838 B2 * 10/2013 Osagle ..... H01R 4/4818 439/441
8,882,533 B2 * 11/2014 Brandberg ..... H01R 13/193 439/441
9,136,641 B2 * 9/2015 Bishop ..... H01R 4/4836
2003/0186571 A1 * 10/2003 Lin ..... H01R 12/57 439/83
2004/0142605 A1 * 7/2004 Harada ..... H01R 4/185 439/857
2008/0076277 A1 * 3/2008 Chen ..... H01R 12/57 439/78
2013/0210247 A1 * 8/2013 Wang ..... H01R 12/57 439/83
2014/0024269 A1 * 1/2014 Decker ..... H01R 4/4818 439/733.1

FOREIGN PATENT DOCUMENTS

DE 2432084 A1 1/1976
DE 2515842 A1 10/1976
DE 7811245 U1 5/1979
DE 4312781 C2 10/1994
EP 2608322 A1 6/2013
FR 2448795 A 9/1980
GB 2049307 A 12/1980

* cited by examiner

ELECTRICAL TERMINAL BLOCK

CROSS-REFERENCE TO PRIOR APPLICATIONS

This application is a U.S. National Phase application under 35 U.S.C. § 371 of International Application No. PCT/EP2015/053866, filed on Feb. 25, 2015, and claims benefit to German Patent Application No. DE 10 2014 102 845.7, filed on Mar. 4, 2014. The International Application was published in German on Sep. 11, 2015 as WO 2015/132099 A1 under PCT Article 21(2).

FIELD

The invention relates to an arrangement comprising a terminal block, a discharge resistor and a capacitor.

BACKGROUND

In the field of electrical engineering, capacitors are used for the compensation of reactive power, among other things. Such capacitors normally have a terminal block that can be plugged onto the capacitor.

Such a terminal block for plugging onto a capacitor normally comprises a housing having an electrical current bar arranged inside the housing, the housing having an opening for guiding through a capacitor wire and for electrically contacting said capacitor wire to the current bar, and an opening for receiving an electrical conductor and electrically contacting said electrical conductor to the current bar. Furthermore, some terminal blocks have a further housing opening for receiving a discharge resistor and electrically contacting said discharge resistor to the current bar.

The capacitor wire is guided through the corresponding housing opening and connected directly to the current bar. Moreover, the annular gap between the capacitor wire and the lead-through opening is soldered so as to be gas-tight. Both the electrical conductor and the discharge resistor are inserted through the respective opening into the housing and electrically connected to the current bar using screw connection terminals.

Screw connection terminals, however, have the disadvantage that it cannot be seen from outside whether the screw of the screw connection terminal is tight and therefore whether the electrical conductor and the electrical resistor, respectively, are clamped tightly to the current bar. Furthermore, the screw of the screw connection terminal is to be tightened at a defined torque so that a minimum clamping force is achieved in order to tightly clamp the electrical conductor, which has been inserted into the screw connection terminal, and the discharge resistor, respectively, to the current bar and at the same time, however, not too great a torque is applied that could damage the screw connection terminal.

Moreover, the screws of the screw connection terminal can loosen over time as a result of the influence of temperature changes and shocks such that the clamping effect of the screw connection terminal diminishes and the electrical contact between the electrical conductor and the current bar, or the electrical contact between the discharge resistor and the current bar, is interrupted.

SUMMARY

An electrical terminal block arrangement includes a terminal block with at least one housing having a first insertion opening and a second insertion opening, and a clamping body including a contact metal, a first spring, and a second spring arranged inside the housing; a discharge resistor that includes a plug-in contact, the plug-in contact being plugged in through the first insertion opening of the housing; and a capacitor that includes at least one capacitor wire, the capacitor wire being inserted through the second insertion opening of the housing and being clamped and electrically contacted to the contact metal by the second spring. The plug-in contact of the discharge resistor is clamped and electrically contacted to the contact metal by the first spring.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
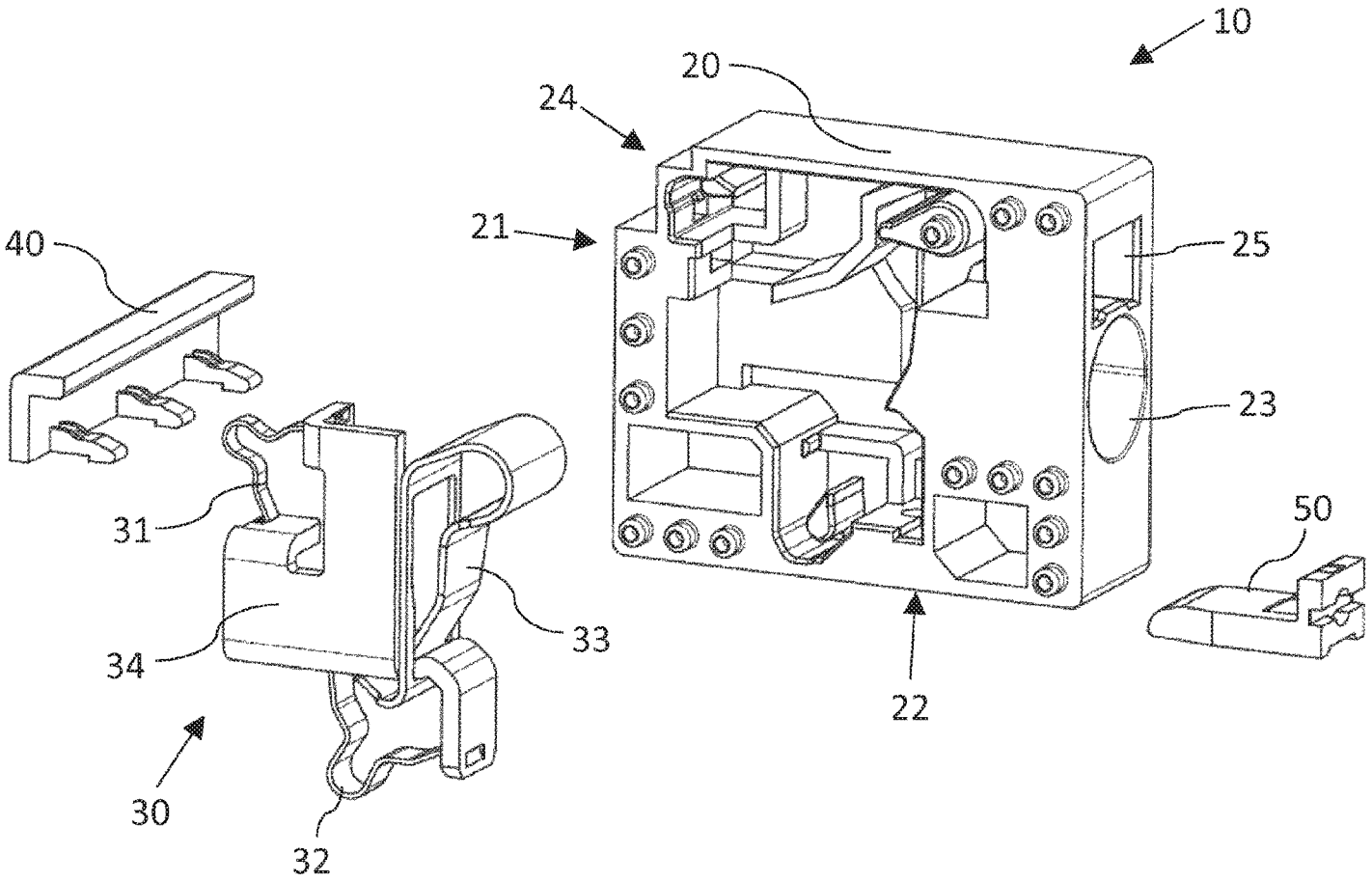
FIG. 1 is an exploded view of a terminal block comprising a movably mounted second pusher according to a preferred embodiment of the invention.

According to the invention, an arrangement comprising a terminal block, a discharge resistor and a capacitor is therefore provided, the terminal block having at least one housing having a first insertion opening and a second insertion opening, and a clamping body comprising a contact metal, a first spring and a second spring being arranged inside the housing, the capacitor having at least one capacitor wire and the capacitor wire being inserted through the second insertion opening of the housing and being clamped and electrically contacted to the contact metal by means of the second spring, the discharge resistor having a plug-in contact and the plug-in contact being plugged in through the first insertion opening of the housing, characterized in that the plug-in contact of the discharge resistor is clamped electrically contacted to the contact metal by means of the first spring.

It is therefore a substantial aspect of the invention that the terminal block has at least one housing comprising a first opening and a second opening, and a clamping body arranged inside the housing, the clamping body comprising a first spring and a second spring. The arrangement therefore provides for the plug-in contact of the discharge resistor to be inserted through the first opening of the housing and to be clamped electrically contacted to the contact metal by means of the first spring. In this way, an arrangement comprising a terminal block, a discharge resistor and a capacitor is specified, the plug-in contact of the discharge resistor being clamped electrically contacted to clamping body by means of a self-adjusting clamped connection.

A further preferred development of the invention provides for the housing to have a third insertion opening and for the clamping body to have a third spring. In this way, a stripped end of an electrical conductor can be inserted through the third insertion opening and can be clamped in a self-adjusting manner to and electrically contacted to the contact metal by means of the third spring.

In a further preferred development of the invention, it is provided for the first spring, the second spring and the third spring to be attached to the contact metal. In this way, the first spring, the second spring and the third spring can be pre-assembled on the contact metal independently of the housing. Subsequently, the clamping body can be arranged in its entirety inside the housing.

In principle, the first spring, the second spring and the third spring can be formed differently from one another. A preferred development of the invention, however, provides for the first spring, the second spring and the third spring to each have a fastening spring leg and to each have a clamping spring leg. In the process, the respective fastening spring legs serve to fix the respective springs in position on the contact metal while the respective clamping spring legs serve to clamp the electrical conductor, the plug-in contact of the discharge resistor, and the capacitor wire, respectively, to the contact metal.

In this context, a preferred development of the invention provides for the first spring to be arranged relative to the contact metal such that the clamping spring leg of the first spring exerts a first spring force on the contact metal, for the second spring to be arranged relative to the contact metal such that the clamping spring leg of the second spring exerts a second spring force on the contact metal and for the third spring to be arranged relative to the contact metal such that the clamping spring leg of the third spring exerts a third spring force on the contact metal. In this way, the respective clamping spring legs of the first spring, of the second spring and of the third spring each produce a spring force independently of one another for clamping the electrical conductor, the discharge resistor and the capacitor wire, respectively, to the contact metal. For example, the electrical conductor is thus clamped and electrically contacted to h the contact metal independently of the clamping of the discharge resistor.

The direction from which the electrical conductor is to be inserted into the terminal block and electrically contacted to the clamping body can vary depending on the field of application. A preferred development of the invention is that the direction of the first clamping force of the first spring is substantially perpendicular to the direction of the second clamping force of the second spring, and the direction of the second clamping force of the second spring is substantially perpendicular to the direction of the third clamping force of the third spring.

A further preferred development of the invention provides for the housing to have a first pusher for pivoting the clamping spring leg of the first spring, the first pusher being mounted so as to be movable between an open position and a closed position. In this way, the clamping spring leg of the first spring is pivoted by moving the first pusher from the closed position into the open position such that the clamping of the plug-in contact of the discharge resistor to the contact metal is released. The discharge resistor can therefore be unplugged from the housing, in particular if the discharge resistor needs to be replaced due to its age or due to a defect.

The replacement of the capacitor can also be necessary independently of the replacement cycle of the discharge resistor. Therefore, a further preferred development of the invention is that the housing has a second pusher for pivoting the clamping spring leg of the third spring, the second pusher being mounted so as to be movable between an open position and a closed position. In this way, the clamping spring leg of the third spring is pivoted by pushing the second pusher from the closed position into the open position such that the clamping of the electrical conductor to the contact metal is released. The electrical conductor can therefore be unplugged from the terminal block and the capacitor together with the terminal block can be replaced.

A particularly preferred development of the invention provides for the first pusher to rest on the clamping spring leg of the first spring and/or for the second pusher to rest on the clamping spring leg of the third spring such that the spring force exerted by the respective clamping spring legs moves the first pusher and/or the second pusher into the closed position. In this way, the respective pushers rest in the closed position such that it can be seen from outside that the respective clamping spring legs are pre-tensioned and are therefore exerting a spring force on the contact metal, on the plugged-in and clamped electrical conductor, and on discharge resistor, respectively. Only as a result of the active movement of the pusher from the closed position into the open position are the respective clamping spring legs pivoted such that the clamping of the clamped electrical conductor and of the discharge resistor, respectively, is released. The respective springs are further pre-tensioned by the movement of the pusher from the closed position into the open position such that the clamping spring leg tries to return to its starting position and thus move the pusher back from the open position into the closed position.

As an alternative to the arrangement of the second pusher, a further preferred development of the invention provides for the housing to have an actuating element for pivoting the clamping spring leg of the third spring, the actuating element being mounted so it can be pivoted between an open position and a closed position. In this way, a stripped conductor end of an electrical conductor, which has been inserted through the third insertion opening, can be clamped in a self-adjusting manner and electrically contacted between the third spring and the contact metal by means of a pivotal movement of the actuating element.

Furthermore, a preferred development of the invention provides for the first spring, the second spring and the third spring to each be formed integrally. In this way, the springs can be produced at a low cost.

A capacitor generally has a plurality of capacitor wires arranged next to one another. Therefore, a preferred development of the invention provides for the terminal block to have a plurality of housings each having a first insertion opening, a second insertion opening and a third insertion opening, and each having a clamping body, the respective housings being arranged next to one another. The number of housings arranged next to one another depends on the number of capacitor wires arranged next to one another. The arrangement then provides for each capacitor wire to be inserted into a housing of the terminal block and to be clamped to the corresponding clamping body.

In this context, a further preferred development of the invention provides for the discharge resistor to have a plurality of plug-in contacts when there is a plurality of housings arranged next to one another, in each case one plug-in contact being plugged into the first insertion opening of a corresponding housing and being clamped and electrically contacted to the corresponding contact metal by means of the respective first springs. The discharge resistor for plugging into the terminal block is therefore designed for a plurality of housings arranged next to one another.

In principle, when housings are arranged next to one another, the respective housings can each have a first pusher for pivoting the respective first spring legs of the respective first springs. A further preferred development of the invention, however, provides for the first pusher to be formed integrally for the plurality of housings arranged next to one another. For this purpose, a plurality of lugs is formed on the first pusher, one lug in each case resting on the corresponding clamping spring leg of the respective first springs. In this way, for housings arranged next to one another, the respective clamping spring legs of the respective first springs are pivoted by a movement of the first pusher from the closed position into the open position such that the discharge resistor can be unplugged.

A further preferred development of the invention provides for the electrical terminal block to have insertion devices, by means of which it can be plugged into a base element and preferably locked to the base element.

The invention also relates to the use of a terminal block for plugging onto a capacitor as a capacitor connection, the terminal block comprising at least one housing having a first insertion opening and a second insertion opening, and a clamping body comprising a contact metal, a first spring and a second spring being arranged inside the housing, a plug-in contact of a discharge resistor being inserted through the first insertion opening of the housing and clamped and electrically contacted to the contact metal by means of the first spring, characterized in that the terminal block is plugged onto the capacitor, the capacitor wire of the capacitor being inserted through the second insertion opening of the housing and clamped and electrically contacted to the contact metal by means of the second spring.

Moreover, the preferred developments of the arrangement according to the invention described further above comprising a terminal block, a discharge resistor and a capacitor also apply correspondingly to the above-described use of the terminal block for plugging onto the capacitor.

FIG. 1 is an exploded view of a terminal block 10, the terminal block 10 comprising a housing 20 and a clamping body 30 which can be arranged in the housing 20. The housing 20 has a first insertion opening 21 for receiving a discharge resistor 70 and electrically contacting said discharge resistor to the clamping body 30, a second insertion opening 22 for receiving a capacitor wire 60 of a capacitor and electrically contacting said capacitor wire to the clamping body 30, and a third insertion opening 23 for receiving a stripped conductor end of an electrical conductor and electrically contacting said conductor end to the clamping body 30. Furthermore, the housing 20 comprises a first receiving region 24 for receiving a movably mounted first pusher 40, and a second receiving region 25 for receiving a movably mounted second pusher 50.

The clamping body 30 comprises a contact metal 34, a first spring 31 which is attached to the contact metal 34 and is intended for electrically contacting the discharge resistor 70 to the contact metal 34, a second spring 32 which is attached to the contact metal 34 and is intended for electrically contacting the capacitor wire 60 and the contact metal 34, and a third spring 33 which is attached to the contact metal 34 and is intended for electrically contacting the stripped end of the electrical conductor to the contact metal 34.

Figure 2:
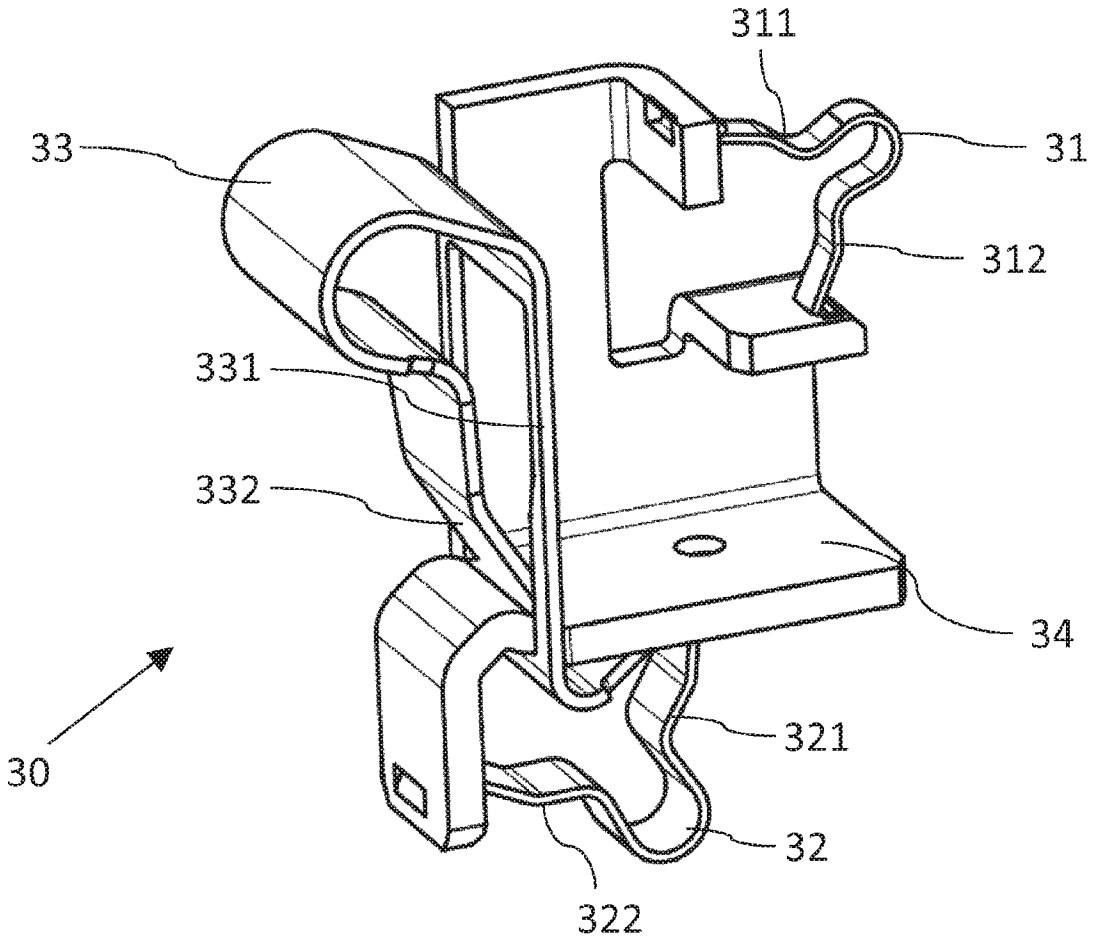
FIG. 2 is a three-dimensional view of the clamping body according to the preferred embodiment of the invention.

As can be seen from FIG. 2, the first spring 31, the second spring 32 and the third spring 33 each have a fastening spring leg 311, 321, 331, respectively, and each have a clamping spring leg 312, 322, 332, respectively. The respective fastening spring legs 311, 321, 331 serve to fix the respective springs 31, 32, 33 in position on the contact metal 34, the respective clamping spring legs 312, 322, 332 serving to clamp the electrical conductor, the discharge resistor and the capacitor wire, respectively, to the contact metal 34.

The springs 31, 32, 33 are arranged relative to the contact metal 34 such that, in each case, the clamping spring leg 312 of the first spring 31 exerts a first spring force on the contact metal 34, the clamping spring leg 322 of the second spring 32 exerts a second spring force on the contact metal 34, and the clamping spring leg 332 of the third spring 33 exerts a third spring force on the contact metal 34. In this way the respective clamping spring legs 312, 322, 332 of the first spring 31, of the second spring 32 and of the third spring 33 each exert a clamping force independently of one another for clamping the electrical conductor, the discharge resistor and the capacitor wire, respectively, to the contact metal 34.

Figure 3:
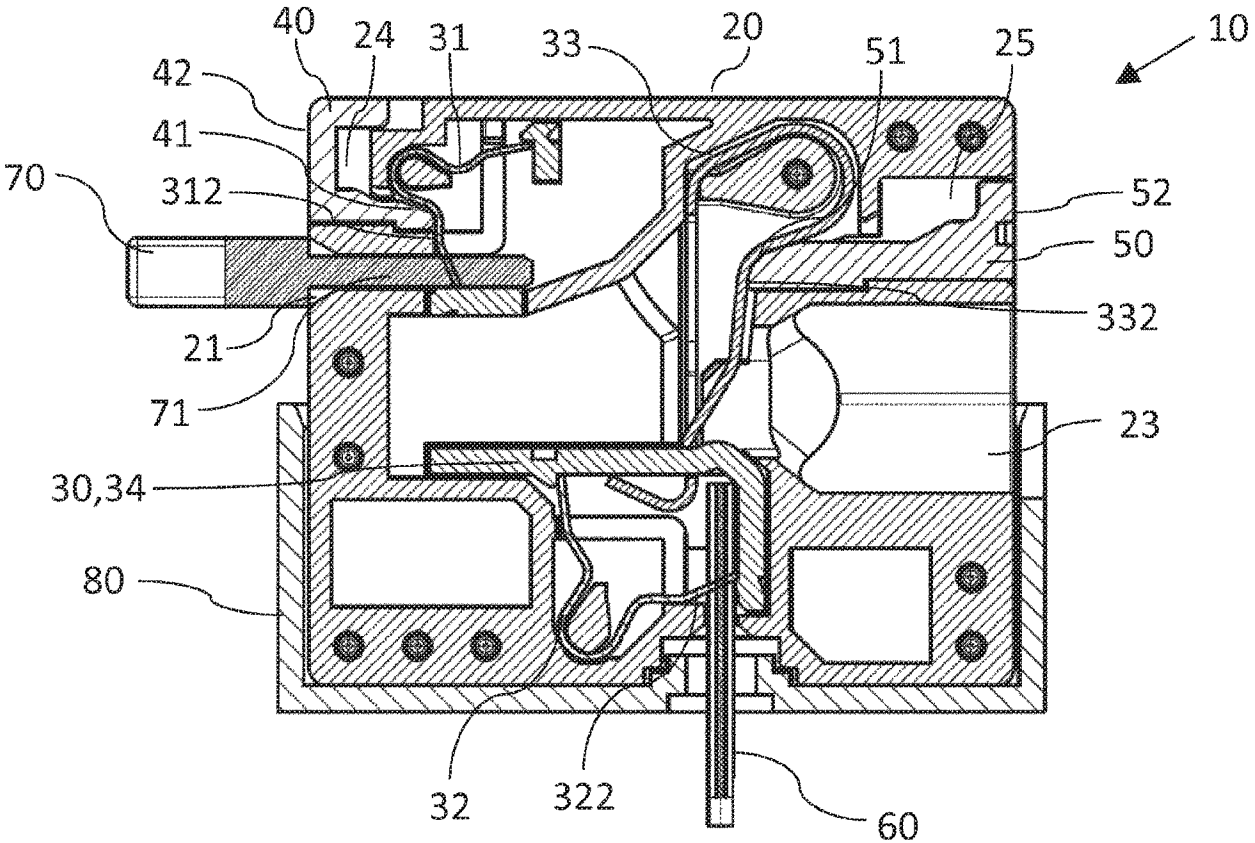
FIG. 3 is a sectional view through the clamping body according to the preferred embodiment of the invention and FIG. 4 is an exploded view of the terminal block comprising a pivotally mounted actuating element according to the preferred embodiment of the invention.

FIG. 3 is a section through the housing 20 of the terminal block 10 having the clamping body 30 arranged inside the housing 20. The clamping body 30 is arranged substantially centrally inside the housing 20. Furthermore, it can be seen from this section that the springs 31, 32, 33 are attached to the contact metal 34 relative to one another such that the direction of the clamping force of the first spring 31 is substantially perpendicular to the direction of the clamping force of the second spring 32, and the direction of the second clamping force of the second spring 32 is substantially perpendicular to the direction of the clamping force of the third spring 33. In this way, the electrical conductor, the capacitor wire 60 and the discharge resistor 70 can each be inserted into the housing 20 from different insertion directions and electrically contacted to the clamping body 30.

It is provided for the electrical conductor to be inserted into the housing 20 through the third insertion opening 23 and to be clamped to the contact metal 34 by means of the clamping spring leg 332 of the third spring 33. The second receiving region 25 having the second pusher 50 movably mounted therein is arranged above the third insertion opening 23. The second pusher 50 is mounted inside the second receiving region 25 so as to be movable between a closed position and an open position. Furthermore, the second pusher 50 comprises an inner end 51 and an outer end 52, the inner end 51 resting on the clamping spring leg 332 of the third spring 33 and the spring force exerted by the clamping spring leg 332 moving the second pusher 50 into the closed position.

In this way, the second pusher 50 rests in the closed position such that it can be seen from the outside that the clamping spring leg 332 is pre-tensioned and is therefore exerting a spring force on the contact metal 34 and, respectively, on the electrical conductor clamped to the contact metal 34. The clamping spring leg 332 is pivoted only by the active movement of the second pusher 50 from the closed position into the open position such that the clamping of the clamped electrical conductor is released. The third spring 33 is further pre-tensioned by the movement of the second pusher 50 from the closed position into the open position such that the clamping spring leg 332 tries to return to its starting position and therefore to move the second pusher 50 from the open position back into the closed position.

Similarly to the principle of the clamping of the electrical conductor to the contact metal 34 by means of the third spring 33, the plug-in contact 71 of the discharge resistor 70 is also clamped to the contact metal 34 by means of the first spring 31.

The plug-in contact 71 of the discharge resistor 70 is plugged into the first insertion opening 21 and clamped to the contact metal 34 by means of the clamping spring leg 312 of the first spring 31. Above the first insertion opening 21, the first pusher 40 is plugged into the first receiving region 24 and mounted so as to be movable between the open position and the closed position. The first pusher 40 comprises an inner end 41 and an outer end 42, the inner end 41 resting against the clamping spring leg 312 of the first spring 31. By moving the first pusher 40 from the closed position into the open position, the clamping spring leg 312 is pivoted such that the discharge resistor 70 can be unplugged from the terminal block. Likewise, by moving the second pusher 50 from the closed position into the open position, the first spring 31 is further pre-tensioned such that the clamping spring leg 312 tries to return to its starting position and therefore to move the second pusher 50 from the open position back into the closed position.

The clamping and contacting of the capacitor wire 60 to the contact metal 34 by means of the second spring 32 is carried out similarly to the electrical contacting of the electrical conductor to the contact metal 34 by means of the third spring 33 or the electrical contacting of the discharge resistor 70 to the contact metal 34 by means of the first spring 31. However, in contrast to the electrical conductor and to the discharge resistor 70, the capacitor wire 60 is clamped to the contact metal 34 by means of the second spring 32 such that it cannot be released. Moreover, the annular gap between the capacitor wire 60 and the second insertion opening 22 is soldered so as to be gas-tight.

Figure 4:
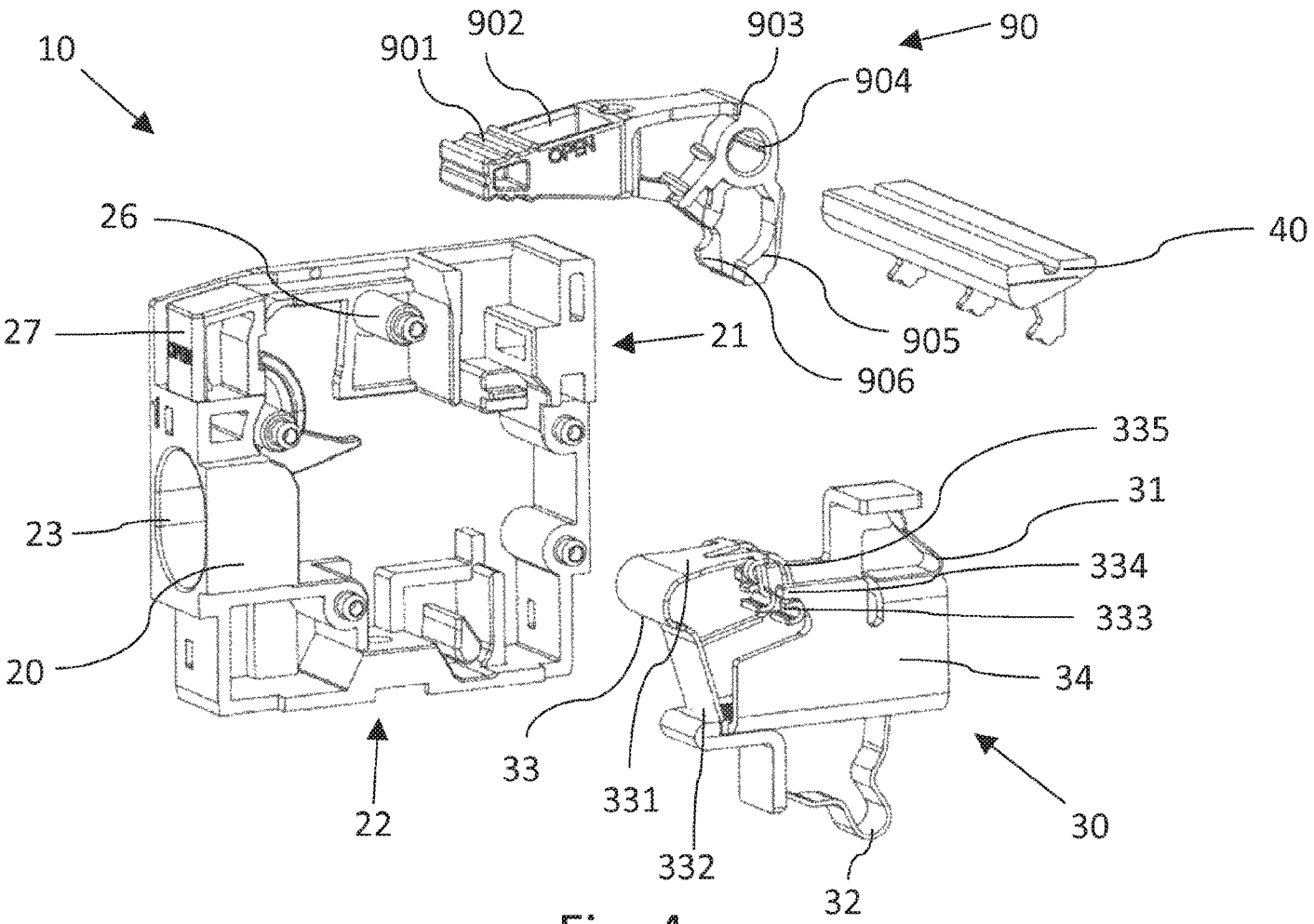

In FIG. 4, the terminal block 10 known from FIG. 1 can be seen comprising a pivotally mounted actuating element 90. The actuating element 90 comprises a handle portion 901 having a recess 902, a receiving portion 903 having an opening 904, and an unlocking portion 905 having a stop 906.

To receive the pivotally mounted actuating element 90, a bearing pin 26 is arranged on the housing 20 and engages in the opening 904 on the receiving portion 903 of the actuating element 90 and constitutes the pivot pin of the actuating element 90. Furthermore, a stamp 27 having a labeling surface is arranged on the housing 20, the stamp 27 engaging in the recess 902 of the actuating element 90 and, in the closed position of the actuating element 90, concealing the labeling surface by means of the handle portion 901 and, in the open position of the actuating element 90, freeing the labeling surface. In this way, the locking state of the actuating element 90 can be seen from the outside.

The first spring 31, the second spring 32 and the third spring 33 are arranged on the contact metal 34 of the clamping body 30. The fastening leg 331 of the third spring 33 comprises two retaining spring legs 335, each comprising a protrusion 333 for latching to the rear catches 334 arranged on the contact metal 34.

Starting from the closed position of the actuating element 90, the actuating element 90 is pivoted into the open position in order to insert a conductor end into the third insertion opening 23. For this purpose, the unlocking portion 905 engages on the retaining spring legs 335 of the fastening spring leg 331 and moves the protrusions 333 out of the rear catches 334. In this way, the clamping spring leg 332 is pivoted such that the conductor end that is to be inserted can be inserted into the contact region. Moreover, in the open position of the actuating element 90, the labeling surface of the stamp 27 is freed such that it can be seen from the outside that the third spring 33 is not exerting any spring force on the contact metal 34 and the conductor end can be inserted into the third insertion opening 23.

In order to clamp the conductor end between the contact metal 34 and the clamping spring leg 332, the pivotally mounted actuating element 90 is pivoted from the open position into the closed position. As a result of the pivotal movement of the actuating element 90, the third spring 33 is pivoted such that the protrusions 333 arranged on the retaining spring legs 335 slide into the rear catches 334 arranged on the contact metal 34. As a result of the pivotal movement, the clamping spring leg 332 of the third spring exerts a spring force on the contact metal 34 in order to clamp and contact the conductor end between the clamping spring leg 332 and the contact metal 34. Likewise, as a result of the pivotal movement of the actuating element 90, the labeling surface arranged on the stamp 27 is concealed by the handle portion 901 of the actuating element 90. It can thus be seen from the outside that the actuating element 90 rests in the closed position and the third spring 33 exerts a spring force on the contact metal 34.

Figure 5:
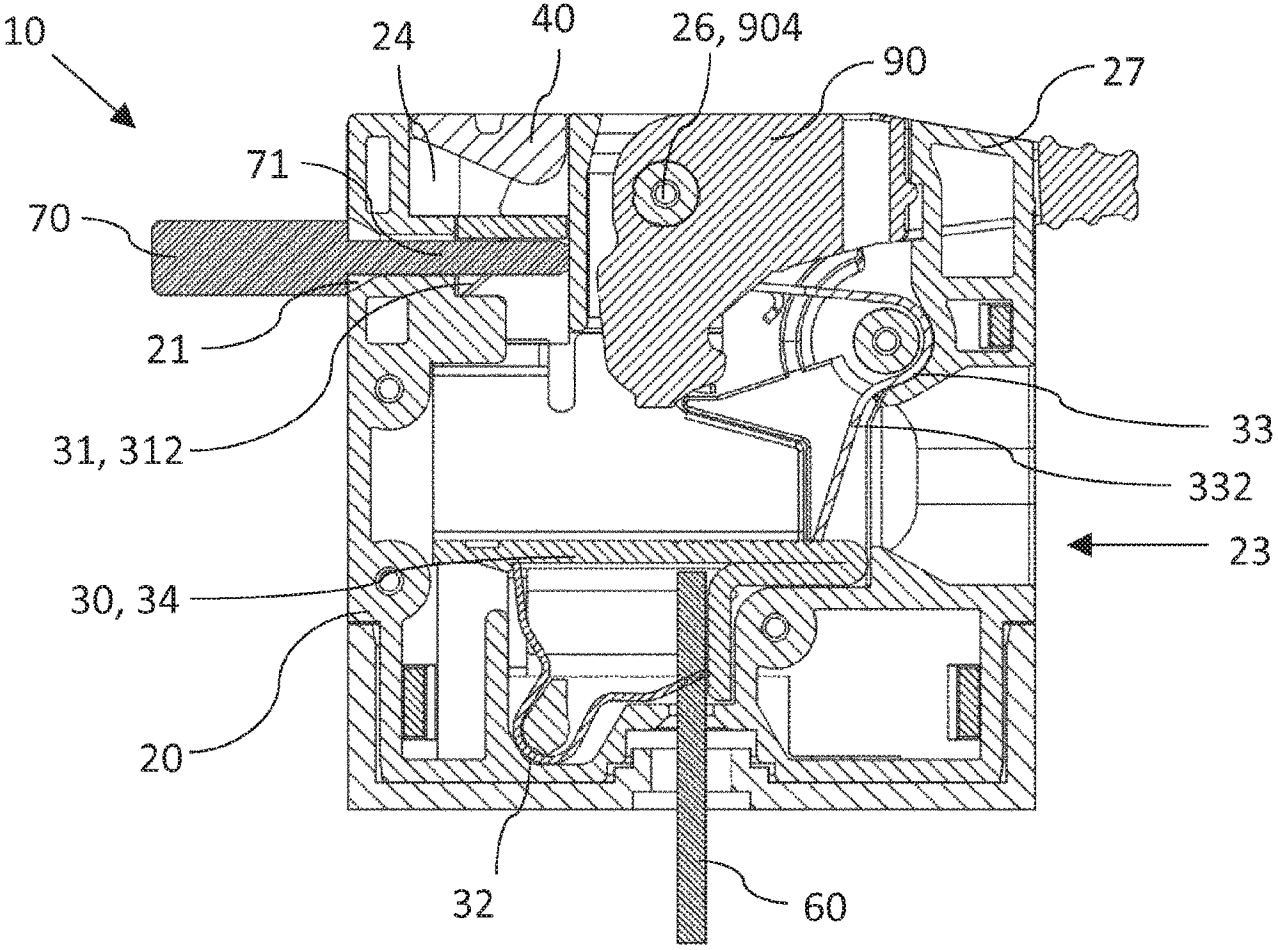
FIG. 5 is a sectional view through the clamping body comprising the pivotally mounted actuating element according to the preferred embodiment of the invention.

FIG. 5 is a section through the housing 20 of the terminal block 10. The terminal block 10 shown in FIG. 5 differs from the terminal block 10 shown in FIG. 3 in that the clamping spring leg 332 of the third spring 33 can be actuated by means of the pivotally mounted actuating element 90. In this way, a stripped conductor end of an electrical conductor inserted through the third insertion opening 23 can be clamped in a self-adjusting manner and electrically contacted between the clamping spring leg 332 of the third spring 33 and the contact metal 34 by means of a pivotal movement of the actuating element 90.

Furthermore, it can be seen that the plug-in contact 71 of the discharge resistor 70 is inserted into the first insertion opening 21 of the housing 20 and clamped and electrically contacted to the contact metal 34 by means of the clamping spring leg 312 of the first spring 31. The first pusher 40 is mounted in the first receiving region 24 of the housing 20 so as to be movable in a direction perpendicular to the insertion direction of the plug-in contacts 71. As a result of a movement of the first pusher 40 from the closed position into the open position, the plug-in contact 71, which is clamped between the contact metal 34 and the clamping spring leg 312, can be released and the discharge resistor 70 can be replaced.

Figure 6:
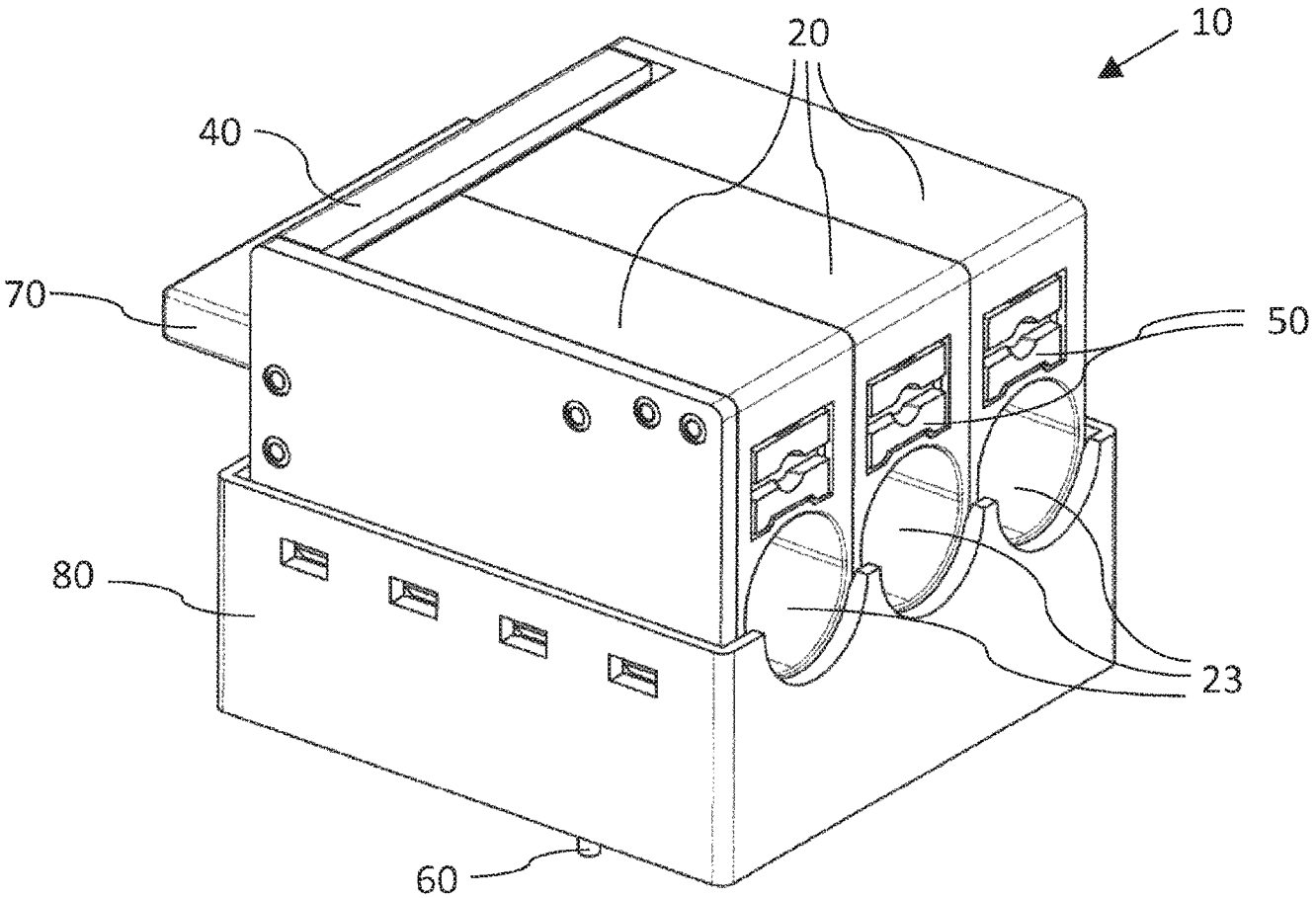
FIG. 6 is a three-dimensional view of the terminal block according to the preferred embodiment of the invention.

As can be seen from FIG. 6, the terminal block 10 comprises a plurality of housings 20 arranged next to one another in a base element 80. The housings 20 are latched to the base element 80 such that they form a solid unit. Furthermore, it can be seen that the respective housings 20 each have a third insertion opening 23 for inserting an electrical conductor and each have a corresponding second pusher 50.

Furthermore, it can be seen from FIG. 6 that the discharge resistor 70 and the first pusher 40 are designed for the plurality of housings 20 arranged next to one another. In this way, the discharger resistor 70, which has been designed and constructed for the plurality of housings 20 arranged next to one another, can be unplugged from the terminal block by means of actuating the first pusher 40.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 Terminal block
20 Housing
21 First insertion opening
22 Second insertion opening
23 Third insertion opening
24 First receiving region
25 Second receiving region
26 Stamp
30 Clamping body
31 First spring
32 Second spring
33 Third spring
34 Contact metal
311, 321, 331 Fastening spring leg
312, 322, 332 Clamping spring leg
333 Protrusions
334 Rear catch
335 Retaining spring leg
40 First pusher
41 Inner end
42 Outer end
50 Second pusher
51 Inner end
52 Outer end
60 Capacitor wire
70 Discharge resistor
71 Plug-in contact
80 Base element
90 Actuating element
901 Handle portion
902 Recess
903 Receiving portion
904 Opening
905 Unlocking portion
906 Stop

The invention claimed is:

1. An electrical terminal block arrangement, comprising:

a terminal block comprising at least one housing having a first insertion opening and a second insertion opening, and a clamping body comprising a contact metal, a first spring, and a second spring arranged inside the housing;

a discharge resistor comprising a plug-in contact, the plug-in contact being plugged in through the first insertion opening of the housing; and a capacitor comprising at least one capacitor wire, the capacitor wire being inserted through the second insertion opening of the housing and being clamped and electrically contacted to the contact metal by the second spring, wherein the plug-in contact of the discharge resistor is clamped and electrically contacted to the contact metal by the first spring, wherein the housing has a third insertion opening and the clamping body has a third spring, wherein the first spring, the second spring, and the third spring each have a fastening spring leg and each have a clamping spring leg, and wherein the housing has a first pusher configured to pivot the clamping spring leg of the first spring, the first pusher being mounted so as to be movable between an open position and a closed position.

2. The arrangement according to claim 1, wherein the housing has a second pusher configured to pivot the clamping spring leg of the third spring, the second pusher being mounted so as to be movable between an open position and a closed position.

3. The arrangement according to claim 2, wherein at least one of the first pusher rests against the clamping spring leg of the first spring, or the second pusher rests against the clamping spring leg of the third spring such that the spring force exerted by the respective clamping spring legs is configured to move at least one of the first pusher or the second pusher into the closed position.

4. The arrangement according to claim 1, wherein the housing has an actuating element configured to pivot the clamping spring leg of the third spring, the actuating element being mounted so as to be pivoted between an open position and a closed position.

5. The arrangement according to claim 1, wherein the terminal block comprises a plurality of housings each having a first insertion opening, a second insertion opening, and a third insertion opening and each having a clamping body, the respective housings being arranged next to one another.

6. The arrangement according to claim 5, wherein the discharge resistor has a plurality of plug-in contacts when there is a plurality of housings arranged next to one another, each plug-in contact being plugged into the first insertion opening of a corresponding housing and being clamped and electrically contacted to the corresponding contact metal by the first spring.

7. A method of plugging a terminal block onto a capacitor as a capacitor connection, the terminal block comprising:

at least one housing having a first insertion opening and a second insertion opening, and a clamping body comprising a contact metal, a first spring, and a second spring arranged inside the housing;

a plug-in contact of a discharge resistor being plugged in through the first insertion opening of the housing and being clamped and electrically contacted to the contact metal by the first spring, the method comprising:

plugging the terminal block onto the capacitor, the capacitor comprising at least one capacitor wire, the capacitor wire being inserted through the second insertion opening of the housing and being clamped and electrically contacted to the contact metal by the second spring, wherein the housing has a third insertion opening and the clamping body has a third spring, wherein the first spring, the second spring, and the third spring each have a fastening spring leg and each have a clamping spring leg, and wherein the housing has a first pusher configured to pivot the clamping spring leg of the first spring, the first pusher being mounted so as to be movable between an open position and a closed position.

8. An electrical terminal block arrangement, comprising:

a terminal block comprising at least one housing having a first insertion opening and a second insertion opening, and a clamping body comprising a contact metal, a first spring, and a second spring arranged inside the housing;

a discharge resistor comprising a plug-in contact, the plug-in contact being plugged in through the first insertion opening of the housing; and a capacitor comprising at least one capacitor wire, the capacitor wire being inserted through the second insertion opening of the housing and being clamped and electrically contacted to the contact metal by the second spring, wherein the plug-in contact of the discharge resistor is clamped and electrically contacted to the contact metal by the first spring, wherein the housing has a third insertion opening and the clamping body has a third spring, wherein the first spring, the second spring, and the third spring each have a fastening spring leg and each have a clamping spring leg, and wherein the housing has an actuating element configured to pivot the clamping spring leg of the third spring, the actuating element being mounted so as to be pivoted between an open position and a closed position.

* * * * *